US005080341A

United States Patent [19]

Lüthy

[11] Patent Number: 5,080,341

[45] Date of Patent: Jan. 14, 1992

[54] SINGULARIZING APPARATUS FOR STACKED PAPER SHEETS AND THE LIKE

[75] Inventor: Ernst Lüthy, Brittnau, Switzerland

[73] Assignee: Grapha-Holding AG, Hergiswil, Switzerland

[21] Appl. No.: 542,708

[22] Filed: Jun. 22, 1990

[30] Foreign Application Priority Data

Jun. 28, 1989 [CH] Switzerland ..... 2404/89-3

[51] Int. Cl.[5] ..... B65H 39/00

[52] U.S. Cl. ..... 270/52; 270/54; 271/12

[58] Field of Search ..... 270/54, 52, 58; 271/11, 271/12

[56] References Cited

U.S. PATENT DOCUMENTS

| | | | |
|---|---|---|---|
| 2,903,260 | 8/1959 | Faeber | 270/54 |
| 3,130,966 | 4/1964 | Hepp | 270/54 |
| 3,552,740 | 1/1971 | Hepp | 271/12 |
| 3,601,495 | 8/1971 | Hepp | 271/12 |
| 4,350,327 | 9/1982 | Müller | 270/54 |
| 4,358,100 | 11/1982 | Müller | 271/11 |
| 4,492,311 | 1/1985 | Glanzmann | 270/54 |
| 4,775,137 | 10/1988 | Glanzmann | 270/54 |

*Primary Examiner*—Edward K. Look
*Assistant Examiner*—Therese M. Newholm
*Attorney, Agent, or Firm*—Peter K. Kontler

[57] ABSTRACT

Apparatus for singularizing stacked paper sheets has a rotary sheet withdrawing unit with a set of equidistant rotatably mounted transfer elements having suction cups which attract successive lowermost sheets of a stack in a magazine adjacent a first portion of the endless path of orbital movement of the transfer elements. The transfer elements deliver the sheets into a second portion of the endless path where the sheets are transferred toward an endless belt conveyor having a reach which advances in the direction of advancement of transfer elements in the second portion of the endless path and at a speed which exceeds the speed of orbital movement of the transfer elements. The leaders of the sheets are caused to abut stops on the endless belt conveyor.

7 Claims, 2 Drawing Sheets

SINGULARIZING APPARATUS FOR STACKED PAPER SHEETS AND THE LIKE

CROSS-REFERENCE TO RELATED CASE

The apparatus of the present invention constitutes an improvement over and a further development of apparatus which is disclosed in the commonly owned copending patent application Ser. No. 07/317,724 filed Mar. 2, 1989 by Hans Müller for "Apparatus for singularizing stacked sheets of paper and the like".

BACKGROUND OF THE INVENTION

The invention relates to improvements in apparatus for singularizing stacked sheets of paper or the like, and more particularly to improvements in apparatus of the type disclosed in the aforementioned commonly owned copending patent application Ser. No. 07/317,724 of Hans Müller.

The Müller application discloses an apparatus wherein a rotor carries a set of rotatably mounted satellites with suction cups which draw successive sheets from a stack adjacent a first portion of the endless path of movement of the satellites with the rotor. The satellites deliver successive sheets to successive grippers of an endless chain conveyor which is adjacent a second portion of the endless path. The movements of the rotor and of the chain conveyor are synchronized so that each gripper which reaches the second portion of the endless path advances in the direction of advancement of the satellites and encounters a sheet-carrying satellite. The grippers of the chain conveyor and/or the satellites are likely to affect the appearance of certain types of sheets if the movements of the grippers are not accurately synchronized with the movements of the satellites.

U.S. Pat. No. 3,602,495 to Hepp discloses a device which is designed to remove sheets from a stack and to transfer the removed sheets to a first belt conveyor which is biased against a rotor for a set of orbiting satellites. The satellites have suction cups which draw successive sheets from a stack and deliver the sheets to a transfer station where the sheets are taken over by the first belt conveyor which cooperates with a second belt conveyor to frictionally engage and entrain the sheets. The direction of movement of the first belt conveyor at the transfer station is counter to the direction of orbital movement of the satellites. Therefore, it is necessary to abruptly accelerate each sheet which reaches the transfer station from the speed of movement with the respective satellite to the speed of movement with the first belt conveyor It has been found that such abrupt acceleration (which necessitates pronounced grasping of sheets by the two belt conveyors) entails the development of stripes, particularly in the region of leaders of the transferred sheets. Furthermore, singularizing apparatus which are designed to abruptly accelerate sheets during transfer from a first transporting unit to another transporting unit are incapable of ensuring uniform spacing of transferred sheets, especially if the sheets are to be transferred at a high or very high frequency which is often necessary in gathering and like machines for signatures and the like.

OBJECTS OF THE INVENTION

An object of the invention is to provide a singularizing apparatus which is less likely to affect the appearance and/or other desirable characteristics of sheets than heretofore known apparatus.

Another object of the invention is to provide an apparatus which ensures predictable spacing of singularized sheets.

A further object of the invention is to provide the apparatus with a novel and improved device for reception and further transport of freshly singularized sheets.

An additional object of the invention is to provide a versatile apparatus which can be rapidly adjusted to singularize short, medium long or long sheets with the same degree of reliability.

Still another object of the invention is to provide a novel and improved method of manipulating sheets on their way from a stacking station to one or more processing stations.

A further object of the invention is to provide an apparatus which is capable of singularizing sheets at a frequency at least matching that achievable in heretofore known apparatus and which is capable of singularizing the sheets with a higher degree of accuracy.

SUMMARY OF THE INVENTION

The invention is embodied in an apparatus for singularizing sheets of paper and the like. The improved apparatus comprises a magazine or another suitable source of stacked sheets, a rotary withdrawing conveyor having a plurality of equidistant transfer elements and means for transporting the transfer elements in a predetermined direction and at a predetermined speed and along an endless path having a first portion adjacent the source of stacked sheets and a second portion. The transfer elements have means for entraining successive sheets of the stack of sheets at the source during transport of successive transfer elements along the first portion of the path, and the apparatus further comprises means for receiving sheets at the second portion of the path. The receiving means comprises an endless conveyor having a stretch or reach which is slightly spaced apart from and extends substantially tangentially of the second portion of the path, and means for driving the endless conveyor at a speed which is higher than the predetermined speed of the transfer elements. The direction in which the endless conveyor is driven is such that the aforementioned reach or stretch of the endless conveyor advances substantially in the predetermined direction in the region of the second portion of the predetermined path.

The endless conveyor of the receiving means can include one or more endless belts or bands.

The means for driving the endless conveyor can include means for driving the endless conveyor at any one of a plurality of different speeds.

The endless conveyor can be provided with a plurality of at least substantially equidistant abutments or stops for the leaders or front ends of sheets which are being transferred toward the endless conveyor at the second portion of the predetermined path. If the source is designed to receive and store stacks of sheets having any one of a plurality of different lengths including a maximum length, the stops of the endless conveyor are spaced apart a distance which at least matches the maximum length.

The apparatus preferably further comprises means for driving the transporting means for the transfer elements in synchronism with the endless conveyor. As mentioned above, the means for driving the endless conveyor preferably includes means for varying the speed of the endless conveyor.

The novel features which are considered as characteristic of the invention are set forth in particular in the appended claims. The improved singularizing apparatus itself, however, both as to its construction and its mode of operation, together with additional features and advantages thereof, will be best understood upon perusal of the following detailed description of certain presently preferred specific embodiments with reference to the accompanying drawing.

DESCRIPTION OF THE PREFERRED EMBODIMENTS

Figure 1:
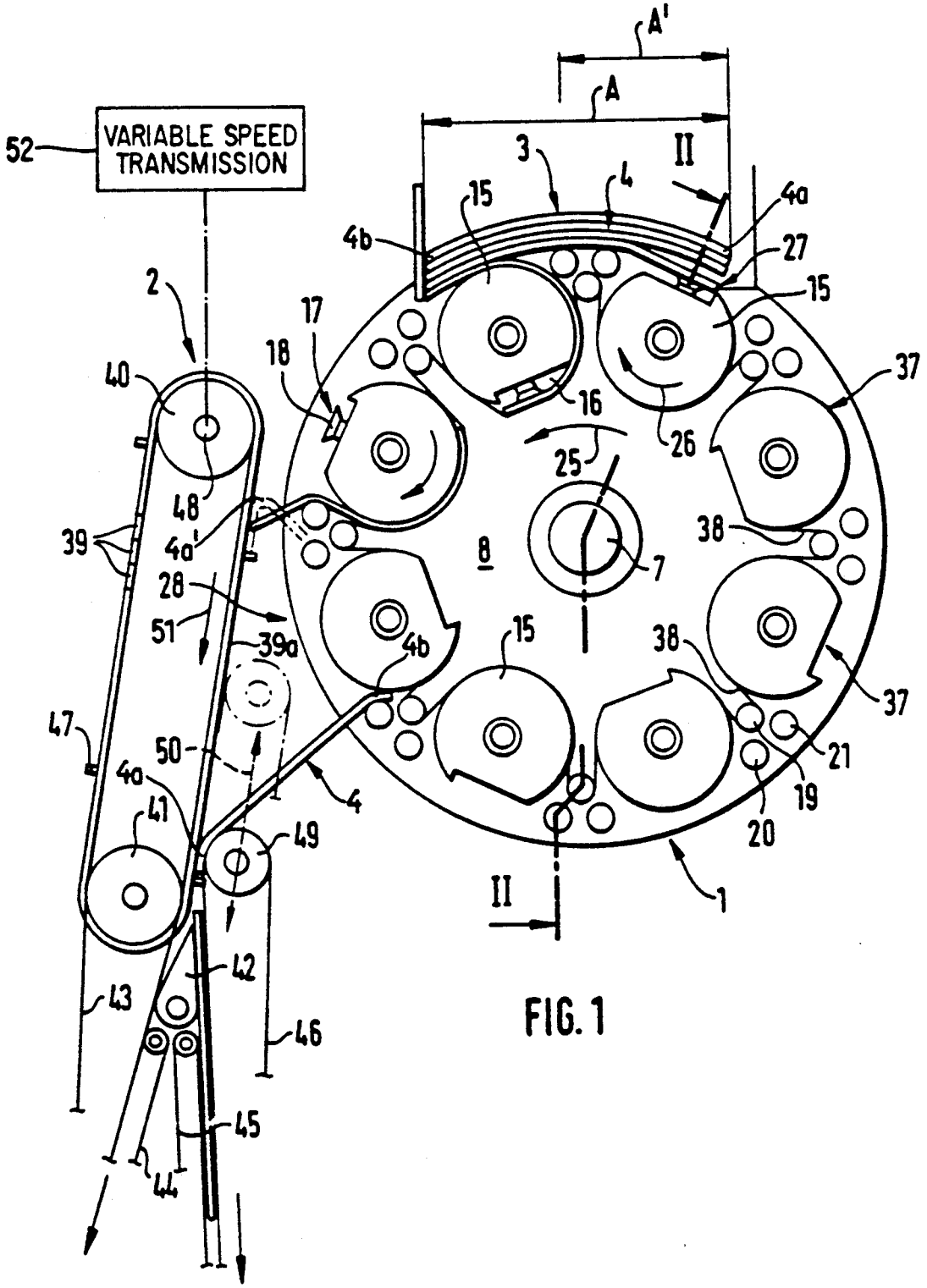
FIG. 1 is a schematic elevational view of a singularizing apparatus which embodies one form of the invention, with one carrier of the means for transporting the transfer elements omitted.
Figure 2:
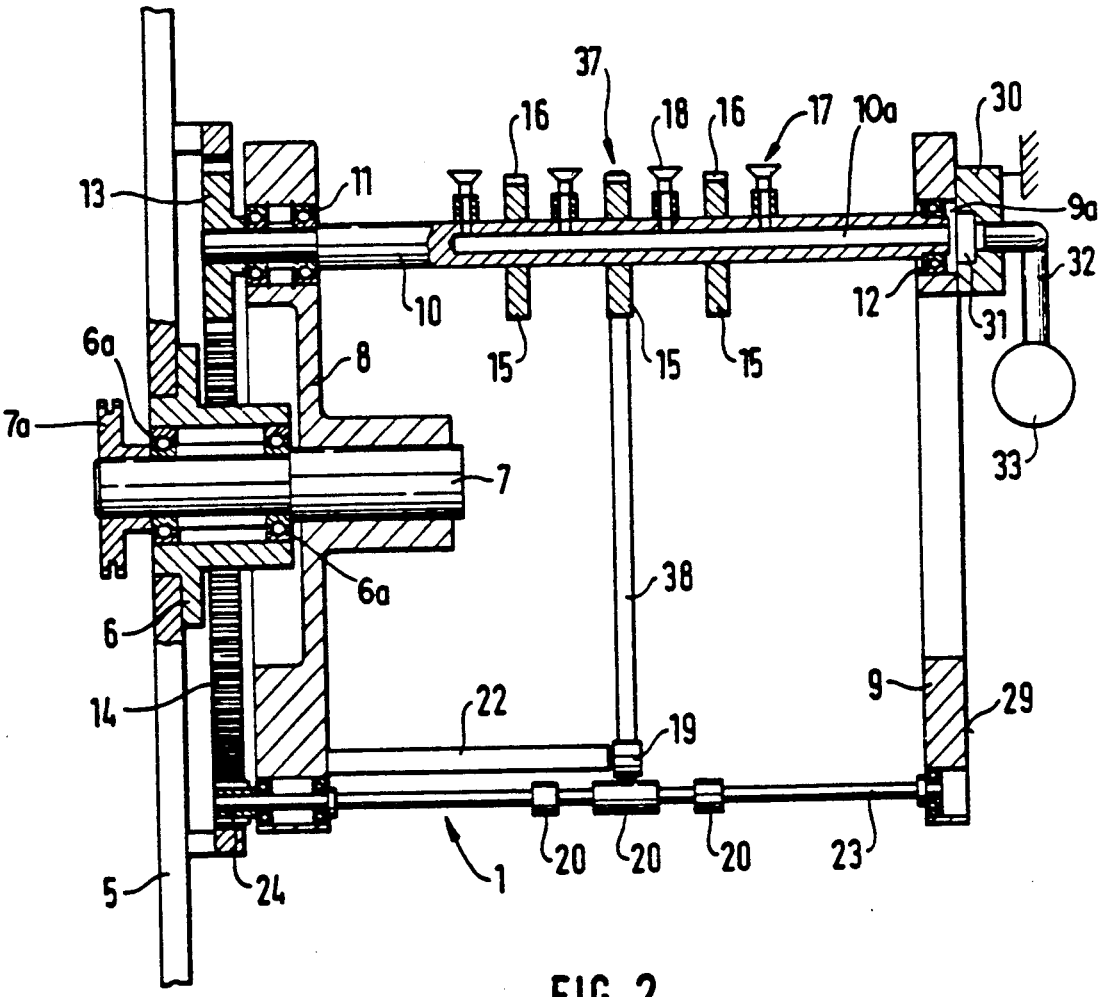
FIG. 2 is a sectional view of the sheet withdrawing conveyor, substantially as seen in the direction of arrows from the line II—II of FIG. 1.

The singularizing apparatus which is shown in FIGS. 1 and 2 comprises a source 3 of stacked sheets 4, a sheet withdrawing conveyor 1 and a sheet receiving conveyor 2. The source 3 is or includes a magazine which can receive relative long or relatively short sheets 4. The maximum length of sheets 4 forming a stack in the magazine 3 is shown at A, and the minimum length of sheets 4 capable of being manipulated or expected to be manipulated in the improved singularizing apparatus is shown at A'.

The details of the withdrawing conveyor 1 are shown in FIG. 2. This conveyor comprises a transporting unit or rotor mounted on an upright wall or cheek 5 and including two axially spaced-apart carriers, namely a substantially disc-shaped carrier 8 adjacent the cheek 5 and a ring-shaped carrier 9 which is remote from the carrier 8 and cheek 5. The cheek 5 supports a fixedly mounted sleeve 6 containing two axially spaced apart anti-friction ball bearings 6a surrounding a shaft 7 forming part of the means for rotating the carriers 8, 9 of the transporting unit about a common horizontal axis. The left-hand end portion of the shaft 7 carries a sprocket wheel 7a forming part of a variable-speed transmission capable of rotating the unit including the carriers 8, 9 at any one of a number of different speeds including a normal or predetermined speed. The direction of rotation of the carriers 8 and 9 is indicated in FIG. 1 by arrow 25.

The transporting unit carries a set of eight parallel equidistant hollow shafts 10. One (solid) end portion of each shaft 10 is rotatably mounted in two antifriction bearings 11 which are provided therefor in the carrier 8, and the other (hollow) end portion of each shaft 10 is rotatably mounted in a single antifriction bearing 12 which is installed in the carrier 9.

The left-hand end portions of the shafts 10 (as seen in FIG. 2) extend beyond the carrier 8 and are fixedly connected with planet pinions 13 mating with an internal gear 14 which is fixedly secured to the cheek 5. When the shaft 7 is driven by the sprocket wheel 7a to rotate the carriers 8, 9 at a predetermined speed in the direction of arrow 25, the shafts 10 share such movements of the carriers but simultaneously rotate about their own axes because the pinions 13 are caused to roll along the internal gear 14. The direction of rotation of the shafts 10 about their own axes is counter to the direction (arrow 25) of rotation of the carriers 8, 9 about the axis of the shaft 7.

Each shaft 10 forms part of a discrete transfer element or satellite 37 further having three spaced-apart coaxial discs 15 with aligned flats 16 and four suction-operated pneumatic gripper devices 17 each having a suction cup 18 adjacent one or two neighboring flats 16. Each of the illustrated transfer elements 37 comprises four gripping devices 17 which alternate with the respective discs 15. Each gripping device 17 extends substantially radially of the respective shaft 10 and has a hollow shank which communicates with a blind bore or hole 10a in the respective shaft 10. Each transfer element 37 includes a shaft 10, three discs 15 and four gripping devices 17 with suction cups 18.

The withdrawing conveyor 1 further comprises guide means for sheets 4 which are transported from a first portion 27 to a second portion 28 of the endless path which is defined by the transporting unit including the carriers 8, 9 for the transfer elements 37. The path portion 27 is adjacent the outlet of the magazine 3, and the path portion 28 is adjacent the downwardly extending straight stretch or reach 39a of an endless belt or band conveyor 39 forming part of the sheet receiving conveyor 2. The guide means comprises an endless flexible band 38 which is trained over approximately one-half of the central disc 15 of each transfer element 37 as well as over idler pulleys 19 which are mounted on the carrier 8 and alternate with the transfer elements 37 in the circumferential direction of the unit including the carriers 8 and 9.

The sheets 4 which are carried by the transfer elements 37 are further adapted to be guided by pairs of guide elements 20, 21 which flank the idler pulleys 19 and are supported by the carrier 9. Each guide element 20 comprises three axially spaced-apart coaxial rollers mounted on a common shaft 23 which is rotatably mounted in anti-friction bearings of the carriers 8, 9 and carries a pinion 24 in mesh with the internal gear 14 on the cheek 5. The construction and mounting of each guide element 21 is or can be identical with that of the guide element 20 which is shown in the lower portion of FIG. 2. Each idler pulley 19 is rotatably mounted on an elongated rod 22 which is fixed to the carrier 8 and extends toward but short of the carrier 9.

When the carriers 8, 9 cause the shafts 10 to orbit about the axis of the shaft 7, the pulleys 19 and the guide elements 20, 21 share such orbital movements in the direction of arrow 25. At the same time, the guide elements 20 and 21 are caused to rotate about their own axes because the pinions 24 on their shafts 23 roll along the stationary internal gear 14. The direction of rotation of transfer elements 37 and guide elements 20, 21 in response to rotation of the shaft 7 and carriers 8, 9 in the direction of arrow 25 is indicated in FIG. 1 by arrow 26.

The suction cups 18 of the pneumatic grippers 17 are connected with a suction generating device 33 (e.g., a vacuum pump) during travel along and beyond the portion 27 of the endless path for the transfer elements 37 in the direction of arrow 25. This causes successive transfer elements 37 to withdraw successive lowermost sheets 4 from the stack in the magazine 3, and the thus withdrawn sheets 4 are thereupon engaged by the adjacent portions of the belt 38 as a result of rotation of the transfer elements 37 about the axes of the respective shafts 10 (arrow 26). The arrangement is such that the suction cups 18 engage and entrain the leaders 4a (right-hand ends) of successive lowermost sheets 4 in the magazine 3 and attract the leaders 4a toward the flats 16 of the corresponding discs 15. A pneumatically engaged sheet 4 is actually peeled off the adjacent next-to-the-lowermost sheet 4 in the stack while the corresponding transfer element 37 advances beneath the magazine 3 in a direction from the portion 27 toward the portion 28 of the endless path for the transfer elements 37. At such time, the lowermost sheet 4 is rolled around the corresponding set of discs 15 (which rotate in a clockwise direction as indicated by the arrow 26 in FIG. 1) to be ultimately fully separated from the adjacent sheet 4 and to move its leader 4a outwardly and away from the corresponding discs 15 as the transfer element 37 continues to advance toward the path portion 28, i.e., toward the transfer station between the conveyors 1 and 2. If the sheets 4 are signatures, the suction cups 17 preferably engage the folds (at 4a) between the two groups of sheets of the respective signatures.

The connection between a suction cup 17 and the suction generating device 33 is or can be interrupted as soon as the partially separated lowermost sheet 4 of the stack of sheets in the magazine 3 is adequately engaged by the peripheral surfaces of the respective discs 15 and the adjacent portion of the flexible band 38. For example, the sheet 4 which is partially convoluted around the disc 15 at or close to the eleven o'clock position of FIG. 2 need no longer be held by the suction cups 18 of the corresponding transfer element 37 because such sheet is already clamped between the corresponding set of discs 15 and the adjacent portion of the band 38. The pairs of guide elements 20, 21 assist (if and when necessary) the sets of discs 15 and the band 38 in properly positioning the sheets 4 which are being advanced from the portion 27 to the portion 28 of the endless path for the transfer elements 37.

The means for connecting the right-hand ends of the blind bores or holes 10a of successive shafts 10 with the suction generating device 33 comprises a stationary valving element 30 having an arcuate groove 31 adjacent the smooth outer side 29 of the carrier 9. The valving element 30 is biased against the outer side 29 and the length of its groove 31 is selected with a view to ensure that the bore or hole 10a of a shaft 10 communicates with the suction generating device 33 for an interval of time which is required to reliably withdraw the lowermost sheet 4 from the magazine 3 as the corresponding transfer element 37 advances from the portion 27 toward the portion 28 of its endless path. The groove 31 of the valving element 30 is connected with the suction intake of the suction generating device 33 by a conduit 32. The ring-shaped carrier 9 has a set of eight equidistant holes 9a each of which receives one of the bearings 12 and also establishes communication between the respective bore or hole 10a and the groove 31 during advancement of the corresponding transfer element 37 along and past the path portion 27. The holes 9a connect the respective bores or holes 10a with the atmosphere when the transfer of a sheet 4 from the magazine 3 onto the corresponding transfer element 37 is completed.

When a sheet 4 reaches the transfer station (path portion 28), its leader 4a extends outwardly beyond the peripheries of the carriers 8, 9 and toward the adjacent reach or stretch 39a of the endless belt conveyor 39. Prior to actually contacting and being deflected by the reach 39a, the leader 4a of the sheet 4 in the path portion 28 extends substantially or exactly tangentially of the corresponding set of discs 15.

The endless belt conveyor 39 is trained over two spaced-apart pulleys 40, 41 of the receiving conveyor 2 and is driven at any one of several different speeds by a shaft 48 forming part of a drive means which drives the conveyor 2 in synchronism with the conveyor 1. The endless conveyor 39 can comprise one, two or more endless bands (three bands are shown in FIG. 2) which are driven in the direction of arrow 51. Thus, the direction of movement of that portion of the reach 39a which is adjacent the transfer station (path portion 28) substantially coincides with the direction of movement (arrow 25) of the transfer element 37 at the transfer station. The shaft 48 causes the pulley 40 to drive the conveyor 39 at a speed which exceeds the speed of movement of transfer elements 37 along their endless path.

The stretch or reach 39a of the conveyor 39 need not have any mechanical grippers or analogous sheet grasping and entraining parts. This reach 39a steers the leaders 4a of successive sheets 4 toward a nip of the conveyor 39 with a further endless belt conveyor 46 which is movable up and down (note the double-headed arrow 50) between the solid-line position and the phantom-line position of FIG. 2, depending upon the length of sheets 4 which are being supplied by the transfer elements 37.

The apparatus of FIGS. 1 and 2 further comprises a pivotable switching device 42 which can steer successive singularized sheets 4 between the conveyor 46 and an endless belt conveyor 45 or between two endless belt conveyors 43, 44. The arrangement may be such that the switching device 42 causes a certain number of sheets 4 to advance with the conveyors 45, 46 to a first sheet processing unit and that the device 42 thereupon causes a certain number of successive sheets 4 to advance with the conveyors 43, 44 to a second sheet processing unit.

The outer side of the conveyor 39 is provided with a set of equidistant stops or abutments 47 for the leaders 4a of successive singularized sheets 4. The distance between neighboring stops 47 at least equals the maximum length (A) of a sheet 4 which can be stored in the magazine 3 and which can be singularized by the conveyor 1.

The angular position of the pulley 40 relative to the shaft 48 can be changed, and the pulley 40 can be fixed to this shaft in any one of two or more different angular positions by means of one or more screws, keys or the like. For example, the shaft 48 can be provided with external splines and the pulley 40 can be provided with internal grooves which can receive the splines in two or more different angular positions of the pulley 40 and shaft 48 relative to each other. Such adjustments of the angular position of the pulley 40 relative to the shaft 48 can be carried out if a stack of relatively long sheets 4 is followed by a stack of shorter sheet or vice versa, or if the apparatus is to be adjusted in order to take into consideration the stiffness of the sheets 4.

The means for rotating the shaft 48 at different speeds can include an infinitely variable speed transmission 52 which is shown schematically in FIG. 1 and can be of any known design. Such transmission renders it possible to conform the ratio of the speeds of conveyors 1 and 2 to the format, stiffness and/or other characteristics of sheets 4 in the magazine 3.

The pulley 49 for the endless belt conveyor 46 of the means for receiving singularized sheets 4 adjacent the reach 39a of the endless belt conveyor 39 is movable in directions of arrow 50 by a double-acting cylinder and piston unit, by a rack-and-pinion drive or in any other suitable way. That portion of the conveyor 46 which is trained over the pulley 49 and the reach 39*a* of the conveyor 39 define a substantially wedge-shaped inlet for the leaders 4*a* of successive singularized sheets 4, and such leaders are caused to advance (with the reach 39*a* and as a result of rotation of the respective transfer elements 37 about their axes (arrow 26 in FIG. 2) to reach the tip of the switching device 42 and to be engaged by the conveyors 43, 44 or by the conveyors 45, 46, depending on the selected position of the switching device. The pulley 49 is held in the solid-line position of FIG. 1 when the apparatus singularizes relatively long sheets 4 (format A) and is moved to the raised (phantom-line) position if the apparatus singularizes relatively short sheets (format A').

The operation is as follows:

Successive transfer elements 37 remove successive lowermost sheets 4 from the stack in the magazine 3 during advancement from the portion 27 toward the portion 28 of their path. The speed at which the transfer elements 37 rotate about their own axes (arrow 26) is the same as the speed of orbital movement of such transfer elements with the carriers 8, 9 in the direction of arrow 25. The leaders 4*a* of successive singularized sheets 4 are pushed (by the respective discs 15 in cooperation with the adjacent portions of the band 38) substantially tangentially of and away from the peripheries of the respective sets of discs 15 so that the leaders 4*a* reach and are flexed by the adjacent downwardly moving reach 39*a* of the conveyor 39 which directs the leaders toward the inlet between the conveyors 39 and 46. The speed of the conveyor 39 exceeds the speed of the transfer elements 37 along their endless path and the leaders 4*a* of successive sheets 4 are caused to advance at or at least close to the speed of the conveyor 39 while the trailing ends 4*b* of such sheets continue to advance at the speed which is imparted by the carriers 8, 9 and the rotating transfer elements 37. The results of simultaneous advancement of a singularized sheet 4 by the downwardly moving reach 39*a* and the corresponding transfer element 37 can be seen in FIG. 1 by looking at the sheet 4 the leader 4*a* of which is held between the conveyors 39 and 46. The speed of movement of successive increments of such sheet away from the conveyor 1 equals the peripheral speed of the conveyor 1.

The synchronization of the conveyor 39 with the conveyor 1 is such that the leaders 4*a* of successive sheets 4 invariably engage predetermined portions of the external surface of the reach 39*a*, namely preferably close to and behind a stop 47. The stops 47 constitute optional but desirable features of the conveyor 39.

The speed of the conveyor 39 is preferably selected in such a way that it at most matches but can be somewhat less than the resultant speed of the adjacent leader 4*a* of a sheet 4, such resultant speed being composed of the ejection or expulsion speed on the one hand and the peripheral speed of the carriers 8, 9 on the other hand. The just described ratio of the speed of the conveyor 39 to the speed of the leader 4*a* of a sheet 4 which is engaged by the reach 39*a* can entail a flexing of the leader 4*a* in a manner as indicated in FIG. 1 by phantom lines (as at 4*a*'); thus, the leader 4*a*' forms a loop having a bight which is located behind the tip of the leader 4*a*' (as seen in the direction of arrow 51). Such loop compensates for the difference between the speed of the reach 39*a* and the aforediscussed resultant speed of the leader 4*a* which approaches the conveyor 39 and is being advanced as a result of movement of the conveyor 1 about the axis of the shaft 7 as well as due to simultaneous rotation of the corresponding transfer element 37 about the axis of its shaft 10. The nearest stop 47 is engaged by the tip of the leader 4*a*' and ensures that such tip thereupon advances toward the conveyor 46 at the exact speed of the reach 39*a*.

The timing of arrival of the leader 4*a* of a sheet 4 into the inlet between the conveyors 39, 46 is selected in such a way that the arrival takes place simultaneously with advancement of the trailing end 4*b* of the sheet 4 beyond the respective transfer element 37. Thus, the trailing end 4*b* is no longer frictionally engaged by the band 38 and by the peripheral surfaces of the corresponding discs 15 when the leader 4*a* is engaged and entrained by the conveyor 46 in cooperation with the conveyor 39. This reduces and actually eliminates the likelihood of the development of stripes or other defects which would detract from the appearance of singularized sheets 4.

If the sheets 4 are relatively short (e.g., having the format A'), their trailing ends 4*b* are released by the respective transfer elements 37 sooner than the trailing ends of longer sheets. Since it is desirable to control the movements of singularized sheets during each and every stage of their movement beyond the respective transfer elements 37, the leaders 4*a* of shorter sheets 4 must be positively engaged by the conveyors 39, 46 at a location which is nearer to the point where the reach 39*a* is closest to the conveyor 1. Therefore, the pulley 49 is moved upwardly to the position which is indicated by phantom lines to ensure that the leader of a short sheet is positively engaged by the conveyors 39, 46 at the exact moment when the trailing end of such short sheet is released by the corresponding transfer element 37. The movements of the conveyor 46 in directions which are indicated by the double-headed arrow 50 need not entail any changes of synchronization of the conveyors 1 and 2.

The pulley 49 can be moved to one, two or more intermediate positions, depending upon the length of sheets 4 which are stacked in the magazine 3.

The stops 47 can ensure that the spacing of sheets 4 which are transported away by the conveyors 43, 44 or 45, 46 is uniform. Thus, if the leader 4*a* of each of a shorter or longer series of singularized sheets 4 abuts a stop 47 at the time the leader 4*a* enters the inlet between the conveyors 39, 46, the sheets 4 which advance with the conveyors 43, 44 or 45, 46 are bound to be equidistant from each other because the stops 47 are equidistant from one another. This holds true irrespective of the speed at which the sheets 4 are singularized on their way from the portion 27 to the portion 28 of the endless path for the transfer elements 37.

The variable-speed transmission 52 can be designed to automatically change the speed of the shaft 48 and conveyor 39 in response to introduction into the magazine 3 of a stack of sheets which are shorter or longer than the sheets of a preceding stack. Alternatively, the variable speed transmission 52 can be designed to change the effective length of the magazine 3 so that the latter is then ready to receive a stack of sheets having a format corresponding to the selected speed of the shaft 48.

Certain other types of singularizing apparatus for stacked sheets of paper or the like are disclosed in commonly owned U.S. Pat. Nos. 4,350,327, 4,358,100, 4,491,311 and 4,775,137.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the appended claims.

I claim:

1. Apparatus for singularizing sheets of paper and the like, comprising a source of stacked sheets; a rotary withdrawing conveyor having a plurality of equidistant transfer elements and means for transporting said transfer elements in a predetermined direction, at a predetermined speed and along an endless path having a first portion adjacent said source and a second portion, said transfer elements having means for entraining successive sheets of the stack of sheets at said source during transport along the first portion of said path; and means for receiving sheets directly from successive transfer elements at the second portion of said path, said receiving means comprising an endless flexible conveyor having a reach spaced apart from and extending substantially tangentially of said second portion of said path, and means for driving said endless conveyor at a speed exceeding said predetermined speed and in a direction such that said reach advances substantially in said predetermined direction in the region of said second portion of said path.

2. The apparatus of claim 1, wherein said endless conveyor includes at least on endless belt.

3. The apparatus of claim 1, wherein said means for driving said endless conveyor includes means for driving said endless conveyor at a plurality of different speeds.

4. The apparatus of claim 1, wherein said endless conveyor comprises equidistant stops for the sheets.

5. The apparatus of claim 4 for singularizing sheets having one of a plurality of different lengths including a maximum length, wherein said stops are spaced apart a distance at least matching said maximum length.

6. The apparatus of claim 1, further comprising means for driving said transporting means in synchronism with said endless conveyor.

7. The apparatus of claim 6, wherein said means for driving said endless conveyor includes means for varying the speed of said endless conveyor.

* * * * *